United States Patent [19]

Penttila

[11] 3,991,977

[45] Nov. 16, 1976

[54] VEHICLE JACK

[75] Inventor: Wilfred K. Penttila, Guelph, Canada

[73] Assignee: The Raymond Lee Organization, Inc., New York, N.Y. ; a part interest

[22] Filed: July 14, 1975

[21] Appl. No.: 595,856

[52] U.S. Cl. ..... 254/71

[51] Int. Cl.[2] ..... B66F 1/06

[58] Field of Search ..... 254/1, 68, 71, 72, 105, 254/108

[56] References Cited

UNITED STATES PATENTS

| | | | |
|---|---|---|---|
| 1,190,788 | 7/1916 | Mitchell | 254/71 |
| 1,399,279 | 12/1921 | Temple | 254/68 |
| 1,465,895 | 8/1923 | Daniels | 254/68 |
| 2,646,963 | 7/1953 | Usher | 254/108 |
| 2,727,717 | 12/1955 | Havbert | 254/1 |

FOREIGN PATENTS OR APPLICATIONS

| | | | |
|---|---|---|---|
| 166,802 | 7/1921 | United Kingdom | 254/68 |

*Primary Examiner*—Al Lawrence Smith
*Assistant Examiner*—Robert C. Watson
*Attorney, Agent, or Firm*—Howard I. Podell

[57] ABSTRACT

A vehicle jack which may be employed for towing or lifting purposes, as required. The jack incorporates a lifting hook slidably fastened by rachet means to a jack bar fitted with transverse rachet teeth, with a hollow collar fixed at the end of the jack bar of a size to pass about a length of chain. The lifting hook is also fitted with a hole of a size to pass about a length of chain. Together with a removable lift plate, the jack bar and lifting hook may be employed in customary fashion to lift a vehicle by the vehicle bumper. Alternately, a length of chain may be fastened at one end to a fixed object or stake and passed through the collar and lifting hook holes, with a closed loop, fastened to the opposed end of the jack bar fastened about the vehicle bumper for towing purposes. A slidable pin is fitted through a link of the chain to engage the hook teeth, with ratchet movement of the lifting hook resulting in applying tension to the chain and attached vehicle. After the lifting hook has come to the end of its travel on the jack bar, a second slidable pin is fitted through a link of the chain, adjacent to the fixed collar, to hold the chain taut, while the lifting hook is moved in the reverse direction, preliminary to fastening the lifting hook to a chain link for pulling a second length of chain, the length of the jack bar. The chain may be wound on a reel attached to the end of the jack bar.

3 Claims, 5 Drawing Figures

FIG. 1
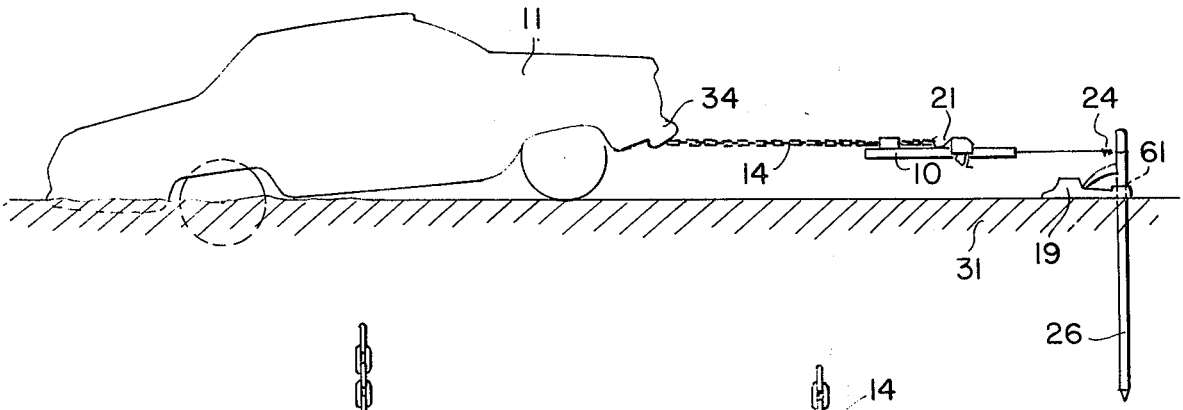
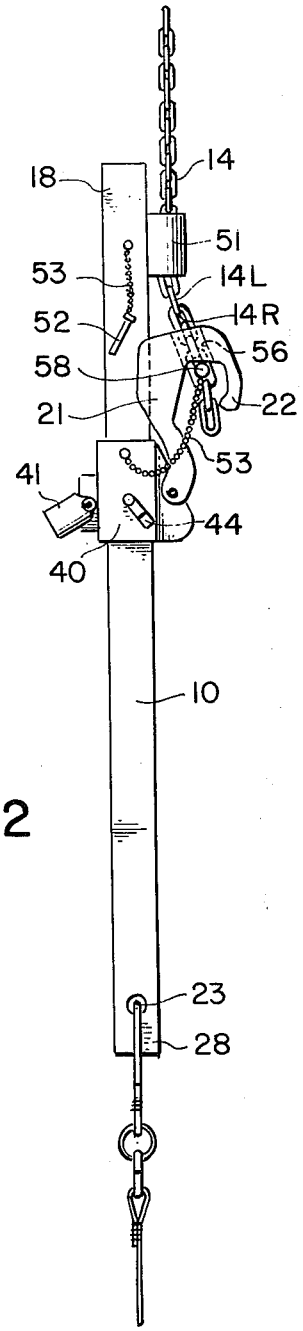
FIG. 2
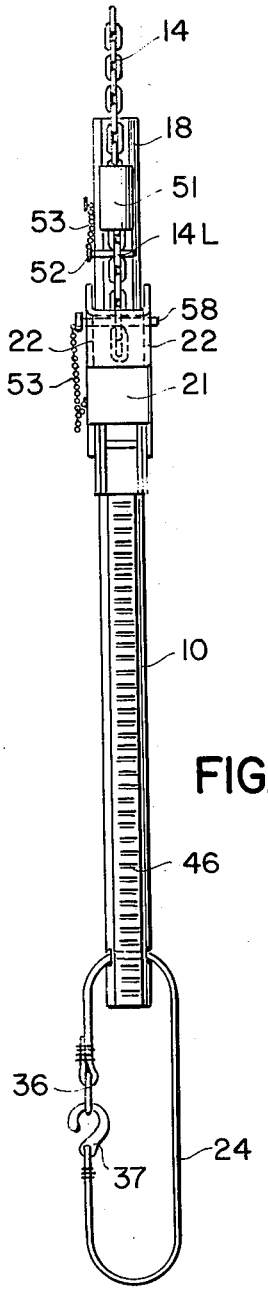
FIG. 3

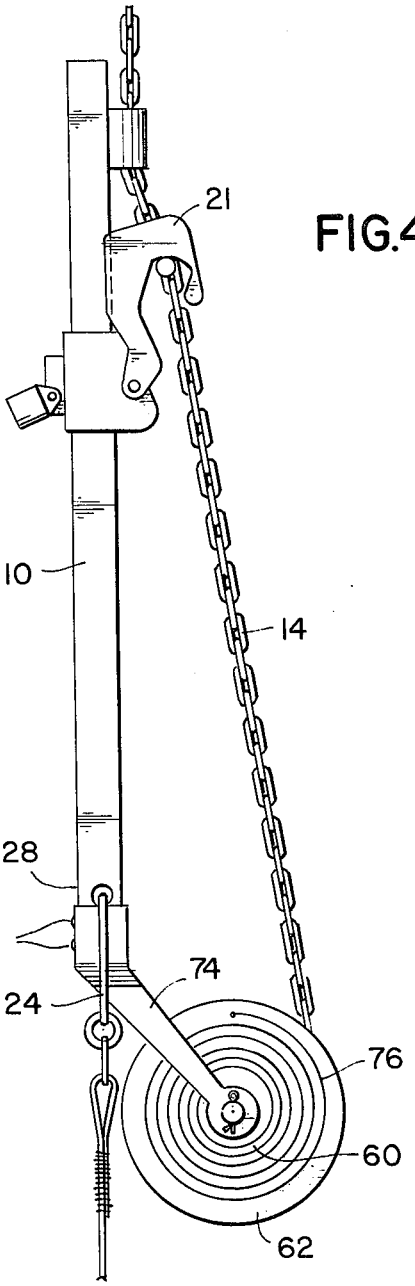
FIG.4
FIG.5
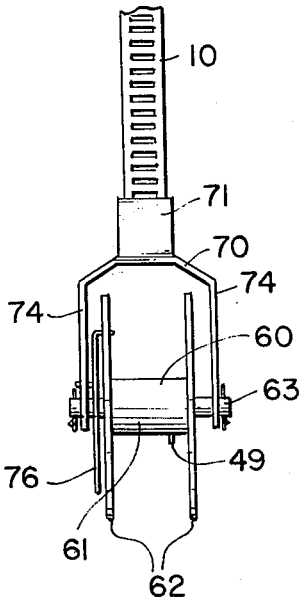

VEHICLE JACK

SUMMARY OF THE INVENTION

My invention is a vehicle jack which may be employed for towing or lifting purposes, as required. The jack incorporates a lifting hook slidably fastened by rachet means to a jack bar fitted with transverse rachet teeth, with a hollow collar fixed at end of the jack bar of a size to pass about a length of chain. The lifting hook is also fitted with a hole of a size to pass about a length of chain.

Together with a removable lift plate, the jack bar and lifting hook may be employed in customary fashion to lift a vehicle by the vehicle bumper.

Alternately, a length of chain may be fastened at one end to a fixed object or stake as passed through the collar and lifting hook holes, with a closed loop, fastened to the opposed end of the jack bar fastened about the vehicle bumper for towing purposes. A slidable pin is fitted through a link of the chain to engage the hook teeth, with rachet movement of the lifting hook resulting in applying tension to the chain and attached vehicle. After the lifting hook has come to the end of its travel on the jack bar, a second slidable pin is fitted through a link of the chain, adjacent to the fixed collar, to hold the chain taut, while the lifting hook is moved in the reverse direction, preliminary to fastening the lifting hook to a chain link for pulling a second length of chain, the length of the jack bar. A reel may be fitted to the end of the jack bar for storing or releasing the chain when the reel is wound or unwound.

BRIEF DESCRIPTION OF THE DRAWINGS

The objects and features of the invention may be understood with reference to the following detailed description of an illustrative embodiment of the invention, taken together with the accompanying drawings in which:

FIG. 1 is a side view of the invention, in use, for towing purposes;

FIG. 2 is a side view of the invention;

FIG. 3 is a plan view of the invention;

FIG. 4 is a side view of an alternate embodiment of the invention; and

FIG. 5 is a fragmentary end view of the alternate embodiment.

DESCRIPTION OF THE PREFERRED EMBODIMENT

Turning now descriptively to the drawings, in which similar reference characters denote similar elements throughout the several views, FIG. 1 illustrates the jack bar 10 in use for pulling a vehicle 11 attached to the end of a chain 14 fastened to the jack bar hook 21, with the jack bar 10 fastened by a closed cable loop 24 about a stake 26 fastened into the ground 31.

Jack bar 10 may be employed as a conventional vehicle lifting jack, with the bottom end 18 of jack bar 10 fastened into a recess in the detachable jack plate 19, and with lift hook 21 of jack bar 10 fastened underneath a vehicle bumper 34. Lift hook 21 is pivotably fastened to a rachet drive collar 40 mounted about jack bar 10. A handle unit 41, pivotably mounted to drive collar 40 causes drive collar 40 to advance along the length of jack bar 10, when handle unit 41 is reciprocably rotated, with the direction of movement of drive collar 40 determined by the position of rotatable direction lever 44. Rachet teeth 46 are mounted along the length of jack bar 10 for engagement with the mechanism of drive collar 40.

A closed flexible loop of cable 24 is fastened through a hole 23 of the top end 28 of jack bar 10, with a hook 37 and eye 36 fastened to the cable to permit opening of the loop, as desired.

The terms "bottom end 18" and "top end 28" refer to the jack bar 10 when used in the vertical position for lifting purposes.

As shown in FIGS. 1–3, a hollow metal sleeve 51 is fastened to jack bar 10 adjacent to first end 18, with sleeve 51 of a size to permit the links 14L of chain 14 to pass through the axial interior of sleeve 51. A pin 52 of a size to freely pass through the recess 14R of a chain link 14L is fixed by a flexible cable 53 to the jack bar 10. Pin 52, when inserted in a chain link 14L adjacent to sleeve 51 prevents loss of tautness in the length of chain 14 between sleeve 14 and the end of the chain fastened to an object being pulled.

A hole 56 of a size to pass chain 14 is formed in lift hook 21 and a pin 58 of a size to fit in a recess 14R of a chain link 14L is fixed by a flexible cable 53 to the drive collar 40. With pin 58 fitted through a chain link 14L and gripped by hook jaws 22, and pin 52 free of engagement with any chain links 14R, movement of drive collar 40 towards second end 28 of jack bar 10 by manual operation of handle unit 41 causes chain 14 to be pulled through sleeve 51, shortening the total distance between loop 24 and fitted about stake 26 and the end of chain 14 fixed to the vehicle 11.

When drive collar 40 has reached the end of its travel towards jack end 28, pin 52 is inserted in a chain link 14L and direction lever 44 is rotated to permit reversal of direction of drive collar 40 movement. Pin 52 holds chain 41 taut against sleeve 51, permitting pin 58 to be removed so that lift hook 21 can be returned to a position on jack bar 10 adjacent to sleeve 51, after which pin 58 is reinserted, pin 52 removed, and the process 15 repeated to again shorten the distance between stake 26 and the vehicle 11. The process can be repeated until the full length of chain 14 has been drawn through sleeve 51, without at any time loosening chain 14 from the taut condition while hook 21 is reset on the chain links.

Removable platform 19 is fitted with a hole 61 through which stake 26 may be driven into the ground 31.

As shown in FIG. 5, a reel 60 may be detachably fastened to the end 28 of the jack bar for winding or unwinding the chain 14.

Reel 60 consists of a roller unit 61 fitted with a pair of circular sidewalls 62 mounted on a shaft 63 rotatably fastened to a U-shaped bracket 70. The mid-portion 71 of bracket 70 is formed with an internal recess of a size and shape to fit over the end 28 of the jack bar, with one or more set screws 72 threaded to the mid-portion 71 for tightening the bracket 70 to the jack bar 10. The sides 74 of bracket 70 are inclined, in the installed position, to the axis of jack bar 10 to locate the reel 60 longitudinally in line with lift hook 21. A torsion spring 76 is wound about shaft 63 and roller unit 61 to provide winding tension to roller unit 61, with a link on the free end of chain 14 fitted over a pin 79 on roller unit 61.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A vehicle jack which may be alternately employed for lifting purposes or for pulling a length of chain, with provisions for maintaining the chain in a taut condition when resetting the chain in engagement with the tension grip member of the jack, comprising a jack bar fitted with a tension grip member in the form of a lift hook mounted on a drive collar that may be manually operated to move, in rachet fashion, in the axial direction of the jack bar, a hollow sleeve fixed to the jack bar adjacent the bottom end of the jack bar, a length of chain of a size to fit through said hollow sleeve, with detachable means to anchor a chain link of said chain to the sleeve or a chain link of said chain to the lift hook, said jack bar fitted with tension fastening means attachable to the top end of the jack bar, with a removable platform attachable to the bottom end of the jack bar which can be employed as a base against which the bottom end of the jack bar may be mounted for use in lifting said platform formed with a through hole, together with a stake of a size to fit through said hole in the removable platform, which stake may be fastened through said hole to fix said platform in position, and to alternately serve as an anchor support means when the jack unit is employed to pull the length of chain.

2. A vehicle jack which may be employed for lifting purposes or for pulling a length of chain, with provisions for maintaining the chain in a taut condition when resetting the chain in engagement with the tension grip member of the jack, comprising a jack bar fitted with a tension grip member in the form of a lift hook mounted on a drive collar that may be manually operated to move, in rachet fashion, in the axial direction of the jack bar, a hollow sleeve fixed to the jack bar adjacent the bottom end of the jack bar, a length of chain of a size to fit through said hollow sleeve and to fasten to the lift hook, with detachable means to anchor a chain link to the said sleeve or a chain link to said lift hook, with fastening means mounted to the top end of the jack bar adaptable for mounting a tension member, together with a reel unit which is attachable to an end of the jack bar, said reel unit of a size to store a length of chain wound on the reel unit.

3. The combination as recited in claim 2 in which the reel unit is fitted with torsion means to furnish torque in the winding direction of the reel unit.

* * * * *